United States Patent [19]

Stucki

[11] Patent Number: 4,603,905

[45] Date of Patent: Aug. 5, 1986

[54] CONTROL MECHANISM FOR AN ADJUSTABLE CHAIR OR THE LIKE

[75] Inventor: Felix Stucki, Thunstetten, Switzerland

[73] Assignee: Girsberger Aktiengesellschaft, Bützberg, Switzerland

[21] Appl. No.: 653,924

[22] Filed: Sep. 24, 1984

[30] Foreign Application Priority Data

Sep. 23, 1983 [DE] Fed. Rep. of Germany ..... 3334424

[51] Int. Cl.[4] ..... A47C 1/022

[52] U.S. Cl. ..... 297/300; 74/524; 297/304; 297/306; 297/366

[58] Field of Search ..... 297/300, 301, 304, 306, 297/366-369, 355; 74/529, 535, 536, 540

[56] References Cited

U.S. PATENT DOCUMENTS

| | | | |
|---|---|---|---|
| 3,873,704 | 9/1974 | Bauer | 297/355 X |
| 4,007,929 | 2/1977 | Figa | 403/353 X |
| 4,200,332 | 4/1980 | Brauning | 297/304 X |

FOREIGN PATENT DOCUMENTS

| | | | |
|---|---|---|---|
| 2710043 | 9/1978 | Fed. Rep. of Germany | 297/300 |
| 7907059 | 4/1980 | Netherlands | 297/300 |
| 8103605 | 12/1981 | PCT Int'l Appl. | 297/355 |

*Primary Examiner*—William E. Lyddane
*Assistant Examiner*—Peter R. Brown
*Attorney, Agent, or Firm*—Peter K. Kontler

[57] ABSTRACT

A chair has an adjustable seat or back rest which is connected with an air spring. The air spring has an engaged condition in which the seat or back rest is locked, and a disengaged condition in which the seat or back rest may be adjusted as desired. A pivotable handle located beneath the seat permits a user to change the condition of the air spring. The handle is connected with a first shaft which carries a first coupling element. A second shaft carries a cooperating second coupling element and acts on an actuating rod of the air spring to change the condition of the latter in response to manipulation of the handle. The shafts are relatively rotatable, and the coupling elements define a gap permitting rotation of one coupling element relative to the other through a distance equalling the length of the working stroke of the actuating rod. In the engaged condition of the air spring, each coupling element is held in a respective end position by a biasing force. The handle is in a lower terminal position. Upward pivoting of the handle to an upper terminal position causes the first shaft and its coupling element to rotate through a distance equal to the length of the working stroke of the actuating rod.

26 Claims, 10 Drawing Figures

CONTROL MECHANISM FOR AN ADJUSTABLE CHAIR OR THE LIKE

BACKGROUND OF THE INVENTION

The invention relates generally to an adjustable seating article such as a chair.

More particularly, the invention relates to a control mechanism for an adjustable seating article, especially an armchair or other chair for office use. Such a control mechanism may be employed to change the position of one or more adjustable components, e.g. the seat and/or the back rest, of the seating article.

A known type of adjustable seating article has an air spring or the like which is connected with an adjustable component of the seating article. Adjustment of the component is performed against the action of the spring. The spring has an engaged condition in which the resistance to adjustment is high and only a limited amount of adjustment is possible. The spring further has a disengaged condition in which the resistance to adjustment is low and adjustment over a wide range is possible. A handle or similar control element is provided to convert the spring between its engaged and disengaged conditions.

In one conventional form of control mechanism, the spring is brought into and maintained in its disengaged condition by applying a force to the handle. The seating article is adjusted as desired while the force continues to be applied to the handle. Once the desired adjustment has been achieved, the handle is released thereby bringing the spring into its engaged condition and locking the seating article in its adjusted position.

This control mechanism is inconvenient since it is difficult to perform adjustments while applying a force to the handle.

In another known form of control mechanism, a special locking element is provided to hold the handle in the position corresponding to the disengaged condition of the spring. A variation of this control mechanism has a handle which is pivotable between two positions respectively corresponding to the engaged and disengaged conditions of the spring. The handle is further mounted for sliding movement, e.g. in axial direction thereof, so as to enable the handle to be locked in the position where the spring assumes its disengaged condition.

While a control mechanism of the type in which the handle can be locked reduces the difficulty of adjustment, it is relatively inconvenient to operate. This is in large part due to the fact that, for the sake of appearance, the handle is located out of sight so that visual observation of the latter during operation is not possible.

OBJECTS AND SUMMARY OF THE INVENTION

It is an object of the invention to provide a control mechanism which enables adjustments to be performed conveniently even though the control element, e.g. a handle, which must be manipulated by the user is out of sight.

Another object of the invention is to provide a control mechanism which does not require a force to be applied to the control element during adjustment.

An additional object of the invention is to provide a control mechanism in which the control element may be released during adjustment but need not undergo a special movement for this purpose.

A further object of the invention is to provide a control mechanism which enables a sturdy construction to be achieved.

It is also an object of the invention to provide a control mechanism which does not require a large amount of space so that it can be accommodated within the limited area available for mounting in a seating article.

Still another object of the invention is to provide an improved control mechanism which may be installed in lieu of a conventional control mechanism without requiring a change in the arrangement of the control element and the spring.

Yet a further object of the invention is to provide a seating article which may be adjusted more conveniently than heretofore.

An additional object of the invention is to provide a seating article which, without requiring a special manipulation, may be adjusted without the need to apply force to a control element during adjustment.

The preceding objects, as well as others which will become apparent as the description proceeds, are achieved by the invention.

The invention provides a control mechanism for a seating article having at least one adjustable component, particularly a seat or a back rest, which is connected with a biasing element, especially an air spring, convertible between a first or engaged condition in which the biasing element offers a higher first resistance to adjustment, and a second or disengaged condition in which the biasing element offers a lower second resistance to adjustment. The control mechanism comprises the following:

(a) A control element for converting the biasing element between its first and second conditions. The control element is preferably in the form of a handle.

(b) A coupling unit for transmitting force between the control element and the biasing element. The coupling unit has a first locked position in which the biasing element is in its first or engaged condition, and a second locked position in which the biasing element is in its second or disengaged condition. The coupling unit is designed to alternately assume the first and second locked positions in response to movement of the control element or handle.

The coupling unit may be considered to constitute a two-stage stepping transmission. The coupling unit enables a simple lifting or similar motion of the handle to be converted into a movement which controls the biasing element and follows a path having two locked positions. In one of these locked positions, the biasing element is in its disengaged condition and remains in this condition even when the handle is released. Adjustment of an adjustable component such as, for example, a seat or a back rest, may then be performed without concurrent application of force to the handle. In the other locked position, the biasing element is in its engaged condition and again remains in such condition when the handle is released.

The coupling unit is advantageously designed in such a manner that both of the locked positions can be achieved within a single stroke or a single path of movement of the handle. This makes it possible to limit movement of the handle to a short distance. Furthermore, the same motion may then be used to sequentially obtain the two locked positions.

The control mechanism may be provided with a pair of relatively rotatable shafts which are preferably coaxial. One of these shafts, which may be referred to as a driven shaft, is provided with a regulating element for the biasing element. The biasing element may have an actuating member, e.g. a slidable rod, which assumes different positions in the different conditions of the biasing element, and the regulating element may be arranged to act upon the actuating member. The regulating element may, for example, be in the form of a lever or projection. The other shaft, which may be referred to as a drive shaft, is connected with the handle. The coupling unit here constitutes a junction between the shafts. The employment of a pair of relatively rotatable shafts between the handle and the biasing element permits the input side of the control mechanism, i.e. the side of the control mechanism corresponding to the handle, to undergo movement relative to the output side of the control mechanism, that is, the side of the control mechanism corresponding to the biasing element. Such relative movement is transmitted between the input and output sides via the coupling unit which establishes a connection between the shafts. Aside from the fact that the coupling unit may function to transmit relative movement between the input and output sides of the control mechanism, the disposition of the coupling unit in the region of the shafts makes it possible to keep the handle and the biasing element in the positions they would occupy with a prior art control mechanism.

The coupling unit may include a pair of cooperating coupling elements each of which is fast with one of the relatively rotatable shafts. The coupling elements may define a gap so as to enable the coupling elements to undergo movement relative to one another. The length of the gap advantageously equals or approximates the distance through which the actuating member of the biasing element must move in order to convert the biasing element from its engaged condition to its disengaged condition, and vice versa. The gap provides a limited clearance for movement of the shafts independently of one another. If, for example, the regulating element on the driven shaft is in a position which causes the actuating member of the biasing element to hold the latter in its disengaged condition, the gap makes it possible, when the handle is in a predetermined position, for the regulating element to spring back freely to a position in which the biasing element assumes its engaged condition.

The control mechanism may be provided with an arresting element which functions to arrest the coupling element on the driven shaft and thereby hold the coupling unit in one of its locked positions. The arresting element may be in the form of a lever and constitute a detent. The control mechanism may further comprise a releasing element which can likewise be in the form of a lever and serves to move the arresting element out of engagement with the coupling element. In this manner, the actuating member of the biasing element may be caused to hold the latter in its disengaged condition without the continuous application of force to the handle. Furthermore, the biasing element may be caused to return to its engaged condition when required by manipulating the handle.

The coupling elements, the arresting element and the releasing element advantageously are all generally flat and arranged so that the major faces thereof are substantially parallel to one another. A major face of each of these elements at least partially overlaps a major face of another of the elements thereby making it possible to couple adjoining elements in a face-to-face relationship. This enables the control mechanism of the invention to be flat and compact so that the control mechanism may be readily adapted to the space present in a seating article.

The novel features which are considered as characteristic of the invention are set forth in the appended claims. The improved seating article and control mechanism, however, both as to their construction and the mode of operating the same, together with additional features and advantages thereof, will be best understood upon perusal of the following detailed description of certain specific embodiments with reference to the accompanying drawings.

DESCRIPTION OF THE PREFERRED EMBODIMENTS

Figure 1:
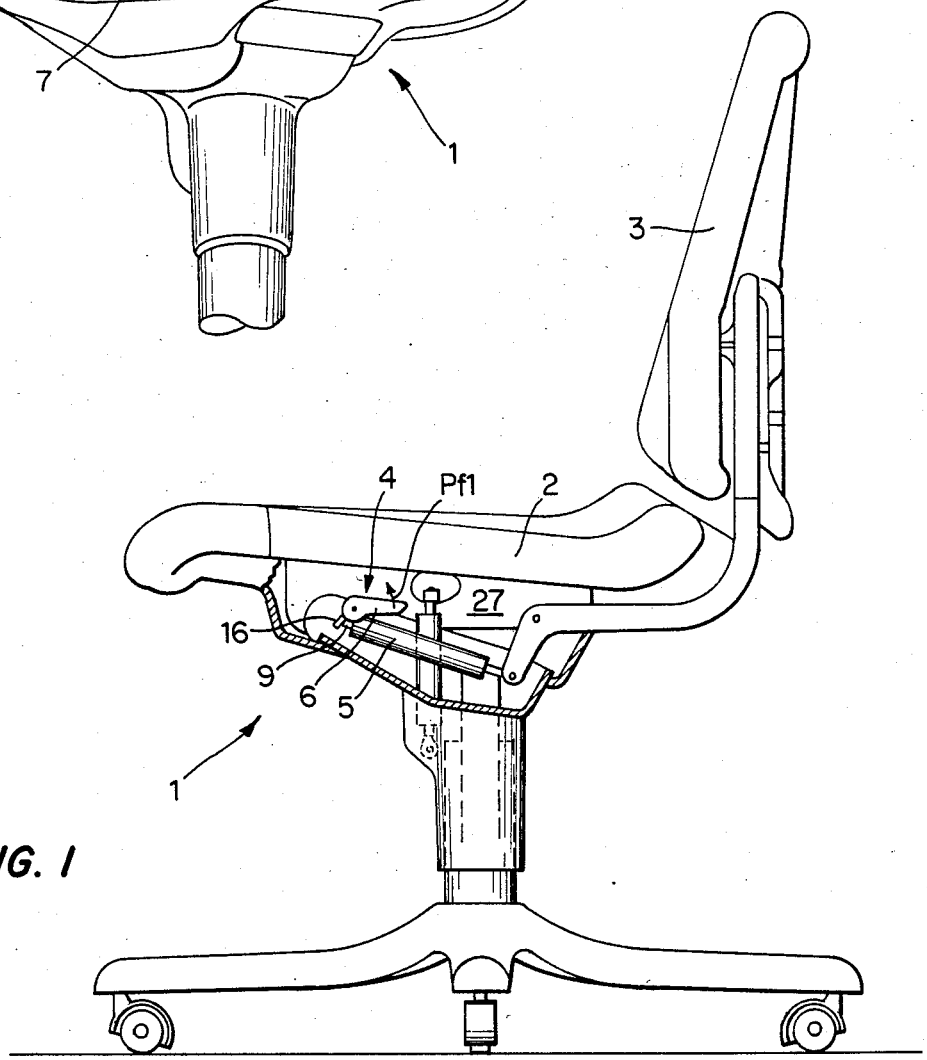
FIG. 1 is a partly sectional side view of an adjustable chair having an adjustment control mechanism in accordance with the invention.

Referring to FIG. 1, the reference numeral 1 generally identifies a seating article which is here shown in the form of a swivel chair for office use. The chair 1 has an adjustable seat 2 as well as an adjustable back rest 3. Control mechanisms are mounted on the chair 1 and function to regulate adjustment of the seat 2 and the back rest 3. For the sake of clarity, only the control mechanism for adjustment of the back rest 3 is illustrated in the drawings. In FIG. 1, this control mechanism is generally identified by the reference numeral 4.

The back rest 3 is adjustable against the action of a biasing element which is here in the form of an air spring 5. The air spring 5 has a first or engaged condition in which the resistance of the air spring 5 to movement of the back rest 3 is high and little, if any, adjustment of the latter is possible. The air spring 5 further has a second or disengaged condition in which the air spring 5 offers little or no resistance to movement of the back rest 3 so that the back rest 3 may be easily adjusted to any desired position. The control mechanism 4 operates to convert the air spring 5 between its engaged and disengaged conditions and, to this end, includes a control element which is here illustrated as being in the form of a handle or lever 6. The handle 6 is designed to be gripped by a hand and is located beneath and to one side of the seat 2. FIG. 1 shows the handle 6 in a first terminal position or rest position. In order to engage or disengage the air spring 5, the handle 6 is pivoted upwardly to a second terminal position as indicated by the arrow Pf1.

To avoid having to continuously grip the handle 6 during adjustment of the back rest 3, the control mechanism 4 is designed such that it has a first locked position in which the air spring 5 assumes its first or engaged condition, and a second locked position in which the air spring 5 assumes its second or disengaged condition. The control mechanism 4 assumes its first and second locked positions alternately as the handle 6 is manipulated. If the control mechanism 4 is in its first locked position, movement of the handle 6 away from its rest position in the direction of the arrow Pf1 causes the control mechanism 4 to go to its second locked position thereby disengaging the air spring 5. Return of the handle 6 to its rest position does not result in movement of the control mechanism 4 back to its first locked position or reversion of the air spring 5 to its engaged condition. However, a second displacement of the handle 6 away from its rest position in the direction of the arrow Pf1 causes the control mechanism 4 to return to its first locked position. This is accompanied by a reversion of the air spring 5 to its original engaged condition in which the air spring 5 can undergo little, if any, adjustment and serves a biasing function.

Figure 2:
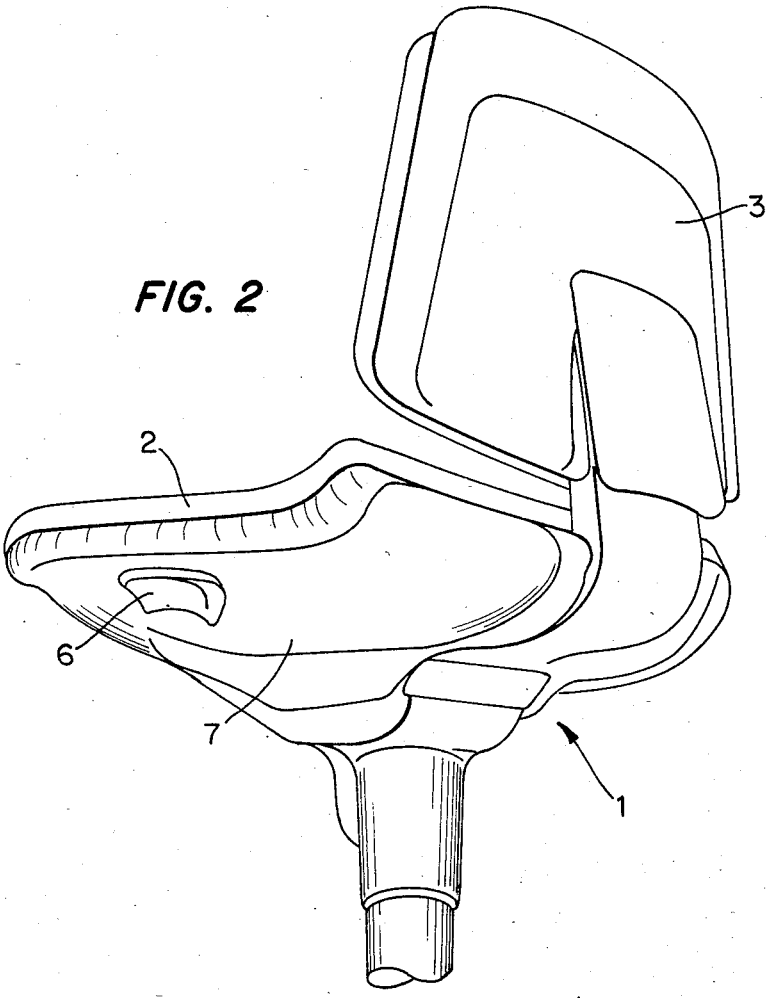
FIG. 2 is a perspective bottom view of the chair of FIG. 1.

FIG. 2 illustrates the position of the handle 6 beneath the seat 2 of the chair 1. It will be observed that the air spring 5, as well as the parts of the control mechanism 4 other than the handle 6, are hidden from view by a flat piece of covering material 7.

Figure 3:
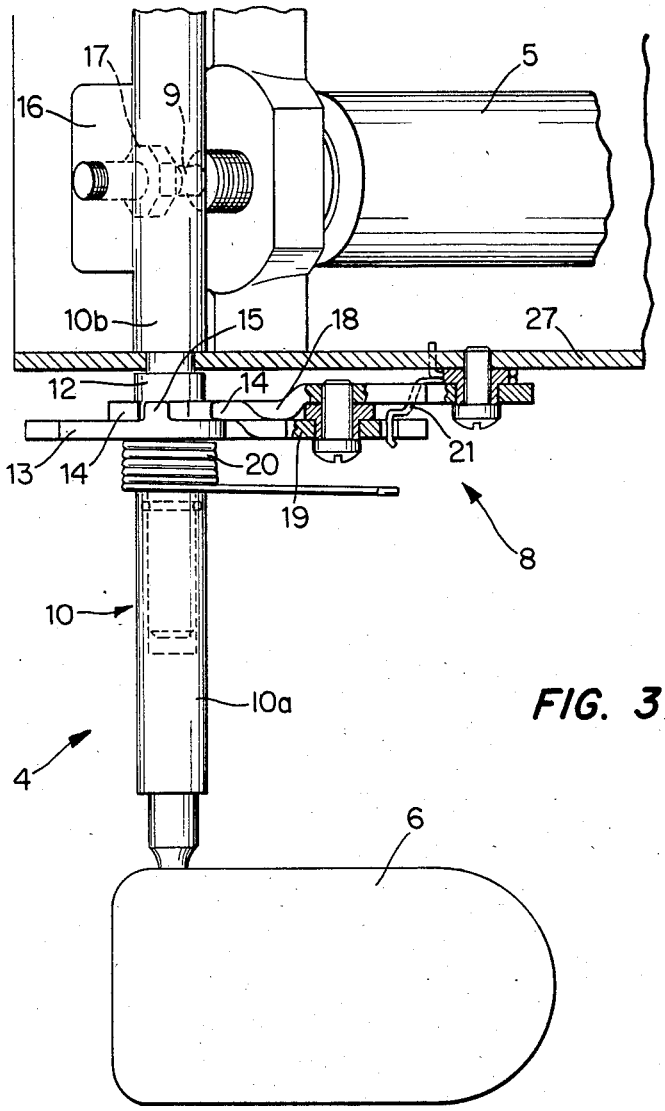
FIG. 3 is a partly sectional plan view of the control mechanism for the chair of FIG. 1.

Alternate shifting of the control mechanism 4 between its first and second locked positions in response to movement of the handle 6 is achieved via a coupling unit or two-stage stepping transmission 8 illustrated in FIG. 3. The coupling unit 8 is arranged to transmit force between the handle 6 and the air spring 5 so that the latter is similarly alternately engaged and disengaged in response to movement of the handle 6.

FIG. 3 shows that the air spring 5 has an actuating rod or member 9 which is slidably mounted in the air spring 5. The actuating rod 9 is movable between an extended position illustrated in FIGS. 1, 3 and 5, and a depressed position illustrated in FIGS. 7 and 9. The air spring 5 is in its engaged condition when the actuating rod 9 is extended, and in its disengaged condition when the actuating rod 9 is depressed. In the extended position of the actuating rod 9, the latter projects from one end of the air spring 5.

The handle 6 is designed to operate the actuating rod 9 and thereby convert the air spring 5 from its engaged condition to its disengaged condition, and vice versa. To this end, a connecting rod 10 is interposed between the handle 6 and the actuating rod 9. The connecting rod 10 includes a pair of coaxial shafts **10*a* and 10*b* which are rotatable relative to one another. The shaft 10*a* receives a portion of the shaft 10*b*. The shaft 10*a* is connected with the handle 6 and may be considered as a drive shaft while the shaft 10*b* is arranged to operate the actuating rod 9** and may be considered as a driven shaft.

The coupling unit 8, which functions to transmit forces between the handle 6 and the air spring 5, and to effect alternate shifting of the control mechanism 4 between its first and second positions, is disposed in the region where the shaft **10*b* enters the shaft 10*a*. The coupling unit 8 constitutes a junction between the shafts 10*a*,10*b* and includes a coupling element 12 which is fast with the shaft 10*b*, and a coupling element 13 which is fast with the shaft 10*a*. The coupling elements 12,13 cooperate with each other to transmit motion between the shafts 10*a*,10*b* and are thus in engagement with one another. The connection between the coupling elements 12,13 is such that the coupling elements 12,13 define a gap which enables the coupling elements 12,13** to rotate independently of each other for a fixed distance.

The coupling element 12, which may be considered as a driven element since it is mounted on the driven shaft **10*b*, is provided with a pair of spaced abutments 14. The coupling element 12 has a disc-like shape, and the abutments 14 are located at the periphery of the coupling element 12. This may be most clearly seen in FIGS. 4, 6, 8 and 10. The coupling element 13, which may be considered as a drive element inasmuch as it is mounted on the drive shaft 10*a*, is formed with a protrusion 15. The protrusion 15 is received between the abutments 14 as may be seen from any of FIGS. 3, 4, 6, 8 and 10. For improved clarity, the coupling element 13 is filled with dots in FIGS. 4, 6, 8 and 10. The width of the protrusion 15 is less than the distance between the abutments 14 so that the protrusion 15 and the abutments 14 together define a gap which extends circumferentially of the coupling element 12. It will be observed that the coupling elements 12,13 can rotate independently of one another for a distance corresponding to the length of the gap. The distance between the abutments 14 and the width of the protrusion 15 are selected in such a manner that the length of the gap equals or approximates the distance through which the actuating rod 9 must be displaced in order to convert the air spring 5 from its engaged condition to its disengaged condition, and vice versa. Consequently, when the drive shaft 10*a* remains stationary, the driven shaft 10*b* is able to rotate sufficiently to displace the actuating rod 9** through a distance equal to its working stroke.

The rotary motion of the driven shaft **10*b* is converted into sliding motion of the actuating rod 9 by means of a projection 16 formed on the driven shaft 10*b*. The projection 16 carries an adjusting screw 17 which bears against the projecting end of the actuating rod 9 and permits precise adjustment of the control mechanism 4. This is shown particularly clearly in FIGS. 4, 6, 8 and 10. When the actuating rod 9 is in its extended position as, for example, in FIG. 5, counterclockwise rotation of the driven shaft 10*b* causes the projection 16 to pivot in a counterclockwise direction. As a result, the screw 17 shifts to the right thereby moving the actuating rod 9 to its depressed position as illustrated, for instance, in FIG. 7**.

Figure 6:
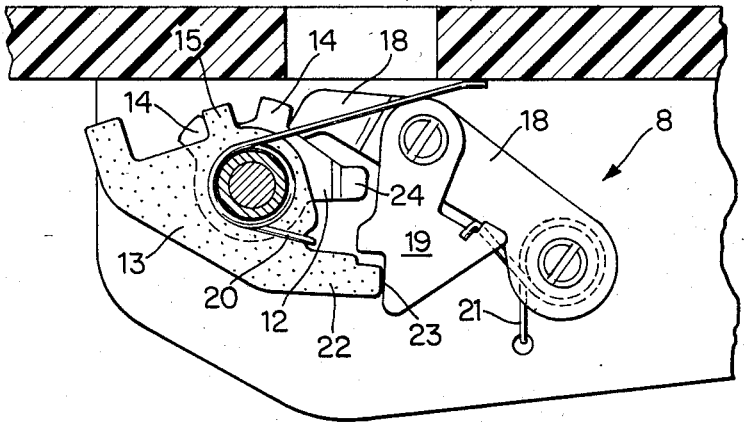
FIG. 6 is similar to FIG. 4 but illustrates an intermediate position of the coupling unit during movement of the latter from the first locked position to a second locked position.
Figure 7:
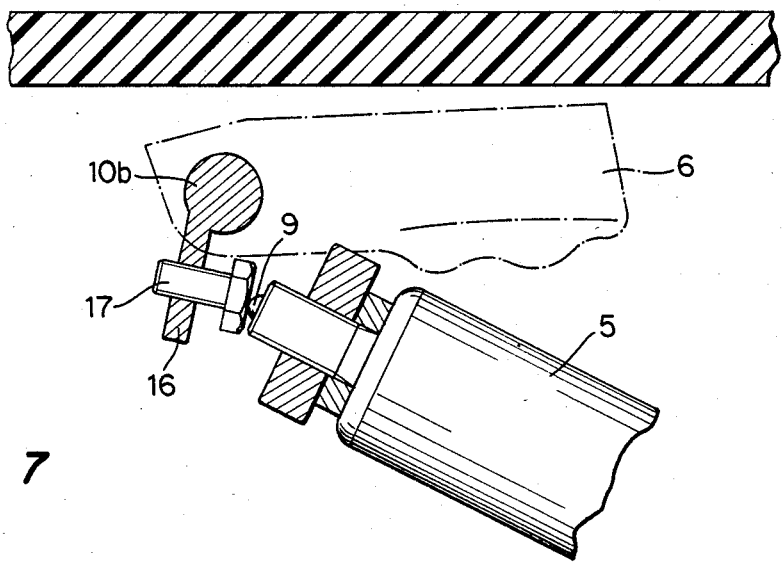
FIG. 7 is similar to FIG. 5 but illustrates the biasing element in a condition corresponding to the position of the coupling unit as shown in FIG. 6.
Figure 8:
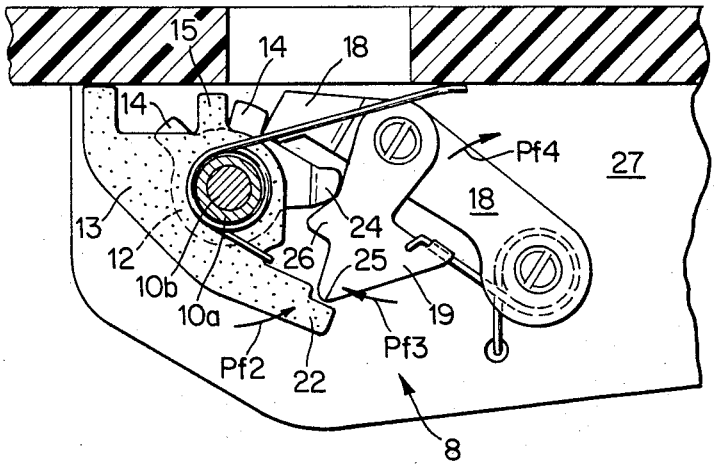
FIG. 8 is similar to FIG. 4 but illustrates the second locked position of the coupling unit.
Figure 9:
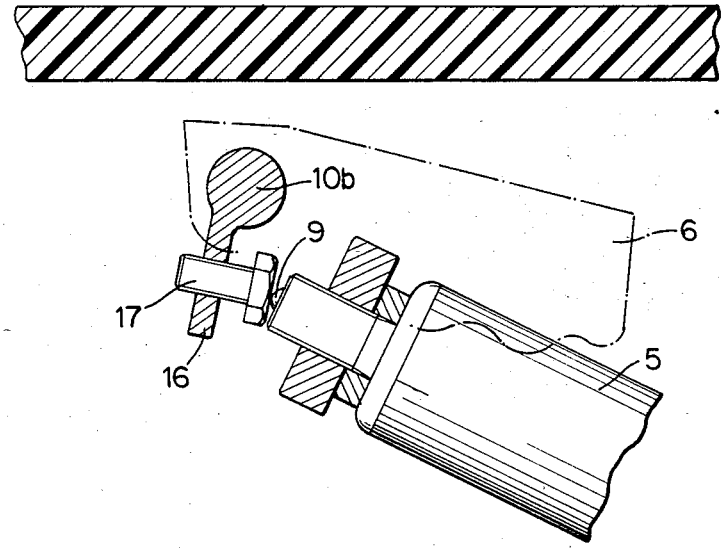
FIG. 9 is similar to FIG. 5 but illustrates the biasing element in a condition corresponding to the position of the coupling unit as shown in FIG. 8.

An arresting element in the form of a lever 18 is pivotally mounted to one side of the connecting rod 10. The arresting lever 18 functions as a detent for holding the driven coupling element 12 against movement. To this end, the arresting lever 18 is arranged to engage one of the abutments 14 of the driven coupling element 12 as best seen in FIGS. 6 and 8. Thus, the driven coupling element 12 and the arresting lever 18 may be considered to constitute a ratchet and pawl. When the arresting lever 18 arrests the driven coupling element 12, the actuating rod 9 is held in the depressed position corresponding to the disengaged condition of the air spring 5 via the coupling element 12, the driven shaft 10*b*, the projection 16 and the screw 17. FIGS. 7 and 9 illustrate the depressed position assumed by the actuating rod 9 upon arrest of the driven coupling element 12.

A releasing element in the form of a lever 19 is pivotally mounted on the arresting lever 18. The releasing lever 19 serves to displace the arresting lever 18 from the arresting position in which the arresting lever 18 holds the driven coupling element 12 against movement. As will be explained below, the releasing lever 19 cooperates with the coupling element 13 and moves the arresting lever 18 out of its arresting position in response to movement of the coupling element 13.

The arresting lever 18 is biased towards the driven coupling element 12, and hence towards its arresting position, by a spring 21. The spring 21 has a pair of legs one of which engages the releasing lever 19 and the other of which engages a lateral flange 27 constituting part of the support structure for the chair 1.

Figure 4:
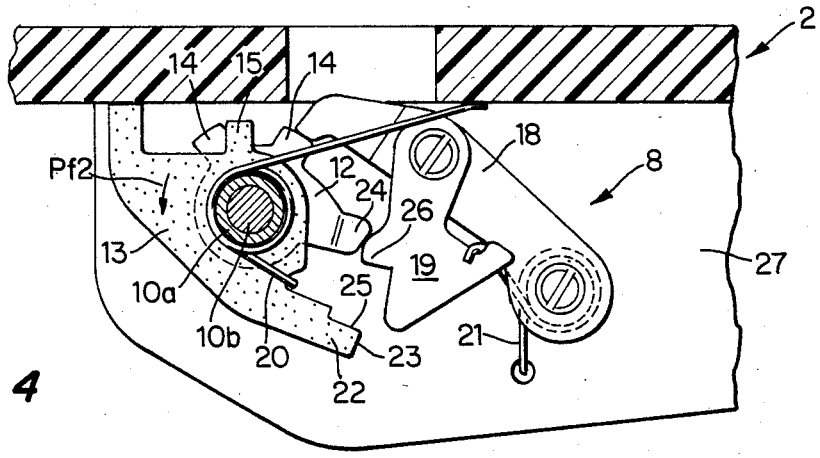
FIG. 4 is a sectional side view illustrating the coupling unit of the control mechanism of FIG. 3 in a first locked position.
Figure 5:
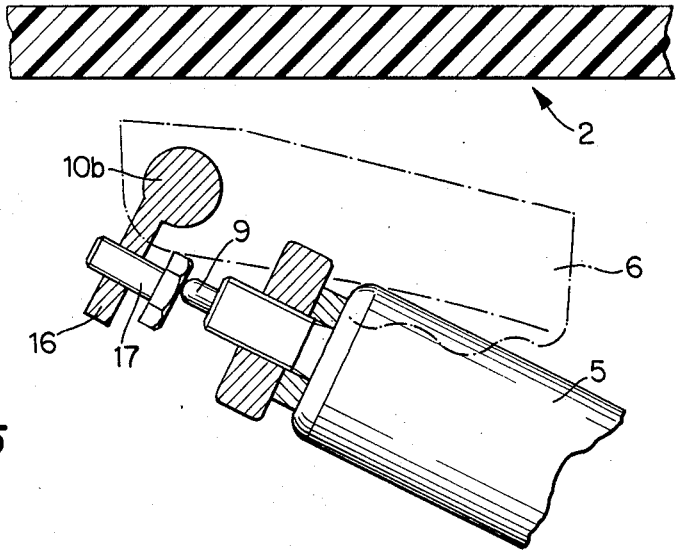
FIG. 5 is a sectional side view illustrating the biasing element for the chair of FIG. 1 in a first condition corresponding to the position of the coupling unit as shown in FIG. 4.

Each of the shafts 10*a*,10*b* has an end position which is illustrated in FIG. 4. The shaft 10*a* is biased towards the respective end position by a spring 20. The spring 20 has a pair of legs one of which engages the coupling element 13 mounted on the drive shaft 10*a* and the other of which engages the seat 2 of the chair 1. On the other hand, the driven shaft 10*b* is urged towards its end position by the actuating rod 9 which tends to assume its extended position. When the actuating rod 9 is in its extended position, the driven shaft 10*b* is in the end position of FIG. 4. The end position of the driven shaft 10*b* is also illustrated in FIG. 5. Although the driven shaft 10*b* is shown as being urged toward its end position by the actuating rod 9, a spring may be provided in order to bias the driven shaft 10*b* towards its end position. The biasing forces exerted on the shafts 10*a*,10*b* will cause the drive shaft 10*a* to assume the end position of FIG. 4, and the driven shaft 10*b* to assume the end position of FIGS. 4 and 5, even though the coupling unit 8 may be in a condition where one of the coupling elements 12,13 is free to rotate without entraining the other.

The connection between the handle 6 and the drive shaft 10*a* is such that the handle 6 is in its rest position when the drive shaft 10*a* is in its end position. The rest position of the handle 6 is shown in FIGS. 1, 5 and 9. In the rest position, the handle 6 is at its greatest distance from the seat 2 of the chair 1.

The operation of the control mechanism 4 will now be described. It will be recalled that only the control mechanism 4 for the back rest 3 of the chair 1 is shown in the drawings, and the following description will accordingly refer to adjustment of the back rest 3. A similar control mechanism may be provided for the seat 2.

As described previously, the air spring 5 has an engaged condition in which the actuating rod 9 is in its extended position. In the engaged condition, the air spring 5 has a high degree of stiffness and offers a high degree of resistance to adjustment of the back rest 3. Only limited adjustment of the latter against the action of the air spring 5 is possible.

The air spring 5 also has a disengaged condition in which the actuating rod 9 is in its depressed position. In the disengaged condition, the air spring 5 offers little, if any, resistance to adjustment, and the back rest 3 may be adjusted as desired. Once the back rest 3 has been adjusted, the desired adjustment may be maintained by returning the air spring 5 to its engaged position.

The operation of the control mechanism 4 is as follows:

It is assumed that the air spring 5 is initially in its engaged condition as shown in FIG. 5. The handle 6 is in its rest position as also illustrated in FIG. 5 and the drive shaft 10*a* is accordingly in the end position of FIG. 4. The driven shaft 10*b* is likewise in the end position of FIG. 4 and, in addition, the arresting lever 18 and the releasing lever 19 assume the positions shown in FIG. 4. The arresting lever 18 is out of the arresting position in which it holds the driven coupling element 12 against movement.

When the handle 6 is pivoted upwards in the direction of the arrow Pf1, the drive shaft 10*a* and its coupling element 13 are rotated counterclockwise in the direction of the arrow Pf2 illustrated in FIG. 4. Since the protrusion 15 of the coupling element 13 bears against the left-hand abutment 14 of the driven coupling element 12, the coupling element 13 entrains the driven coupling element 12 and causes the latter to rotate in the direction of the arrow Pf2. Due to the fact that the coupling element 12 is fast with the driven shaft 10*b*, the shaft 10*b* is likewise caused to rotate counterclockwise in the direction of the arrow Pf2. The projection 16 and the screw 17 mounted on the driven shaft 10*b* are thus pivoted in a counterclockwise direction thereby urging the actuating rod 9 from its extended position to its depressed position.

From its first terminal position or rest position, the handle 6 is pivoted to the second terminal position illustrated in FIG. 7. In the second terminal position, the handle 6 is at its smallest distance from the seat 2 of the chair 1. The actuating rod 9 assumes its depressed position when the handle 6 arrives at its second terminal position. FIG. 7 shows the depressed position of the actuating rod 9 which corresponds to the disengaged condition of the air spring 5.

As illustrated in FIG. 6, the coupling element 13 has rotated the driven coupling element 12 to such an extent upon arrival of the handle 6 at its second terminal position that the arresting lever 18 is free to move to its arresting position behind the right-hand abutment 14 of the coupling element 12. The arresting lever 18 moves to its arresting position under the action of the spring 21. In its arresting position, the arresting lever 18 prevents the driven coupling element 12 from returning to the end position of FIG. 4 under the biasing action of the actuating rod 9. The arresting lever 18 thus locks the air spring 5 in its disengaged position. The arresting lever 18 causes the driven shaft 10*b*, as well as the projection 16 and the screw 17 carried thereby, to remain in the positions of FIG. 7 even when the handle 6 is released so that the air spring 5 continues to be held in its disengaged position.

Upon release of the handle 6, the coupling element 13 is free to rotate in a direction opposite to the arrow Pf2 under the action of the spring 20. Consequently, the coupling element 13 and the associated drive shaft 10*a* return to the end position of FIG. 4. The handle 6, on the other hand, returns to its rest position.

The coupling element 13 is provided with a leverlike nose 22 which confronts the releasing lever 19. The nose 22 has an end face 23 which abuts the releasing lever 19 in the condition of the control mechanism illustrated in FIGS. 6 and 7. The nose 22 holds the releasing lever 19 in the position of FIG. 6 against the action of the spring 21 which attempts to pivot the releasing lever 19 clockwise relative to the arresting lever 18. The releasing lever 19 is maintained in the position of FIG. 6 until the handle 6 is released.

Once the handle 6 has been released, the control mechanism 4 assumes the condition shown in FIGS. 8 and 9. The coupling element 13 and the drive shaft 10*a* are in the end position of FIG. 4 while the handle 6 is in its rest position. Rotation of the coupling element 13 from the position of FIG. 6 to the end position of FIG. 8 causes the nose 22 to move out of engagement with the releasing lever 19. The releasing lever 19 is then free to rotate clockwise relative to the arresting lever 18 in the direction of the arrow Pf3. The releasing lever 19 rotates under the action of the spring 21. Rotation of the releasing lever 19 in the direction of the arrow Pf3 is limited by a cam-like protuberance 24 formed on the driven coupling element 12.

When the control mechanism 4 is in the condition of FIGS. 8 and 9, the back rest 3 may be adjusted as desired. The adjustment may be performed without the need to concurrently apply a force to the handle 6.

From a practical viewpoint, the condition of the control mechanism 4 shown in FIGS. 8 and 9 constitutes a ready condition for release of the driven coupling element 12 from the arresting lever 18. In this regard, the nose 22 of the coupling element 13 has an upwardly directed abutment face 25 which is disposed immediately below the lower end of the releasing lever 19. The nose 22 thus lies on a line constituting an extension of the releasing lever 19.

If the handle 6 is now again pivoted from its rest position to its second terminal position in the direction of the arrow Pf1, the coupling element 13 is, as before, rotated in the direction of the arrow Pf2. As the coupling element 13 rotates, the abutment face 25 of the nose 22 engages the lower end of the releasing lever 19 so that the latter is forced to rotate in the direction of the arrow Pf3. The releasing lever 19 has a nose 26 which abuts the protuberance 24 on the driven coupling element 12 thereby causing the coupling element 12 to rotate counterclockwise as the releasing lever 19 rotates in the direction of the arrow Pf3. Rotation of the releasing lever 19 in the direction of the arrow Pf3 causes a pull to be exerted on the arresting lever 18 via the spring 21. The arresting lever 18 thus rotates in the direction of the arrow Pf4 and out of the arresting position which it occupied behind the right-hand abutment 14.

Once the arresting lever 18 has been displaced from its arresting position, the driven coupling element 12 and the associated driven shaft 10*b* are free to rotate clockwise back towards the end position of FIGS. 4 and 5. Since the actuating rod 9 is biased towards its extended position and is no longer held in its depressed position by the action of the arresting lever 18, the actuating rod 9 now moves from its depressed position to its extended position. The actuating rod 9 thus pivots the projection 16 and the screw 17 carried by the driven shaft 10*b* in a clockwise direction thereby returning the shaft 10*b* and the driven coupling element 12 to the end position of FIGS. 4 and 5. The air spring 5 is again in its engaged condition so that the adjustment made to the back rest 3 while the control mechanism 4 was in the condition of FIGS. 8 and 9 is maintained.

Figure 10:
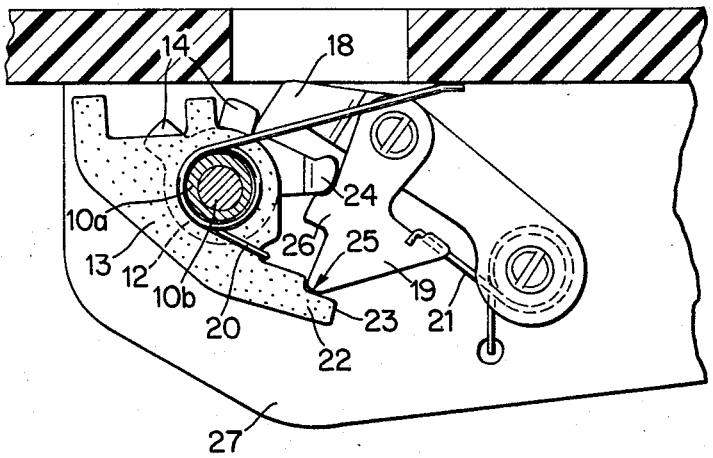
FIG. 10 is similar to FIG. 4 but illustrates another intermediate position of the coupling unit during movement of the latter from the second locked position to the first locked position.

FIG. 10 illustrates an intermediate condition of the control mechanism 4 during release of the driven coupling element 12 from the arresting lever 18. As shown in FIG. 10, the arresting lever 18 is on the verge of moving out of its arresting position behind the right-hand abutment 14. Rotation of the arresting lever 18 beyond the position of FIG. 10 will result in springback of the driven coupling element 12 and the driven shaft 10*b* from the position of FIGS. 8 and 9 to the end position of FIGS. 4 and 5. During springback from the position of FIGS. 8 and 9 to the position of FIGS. 4 and 5, the driven coupling element 12 and the driven shaft 10*b* rotate through a distance which equals or approximates the length of the working stroke of the actuating rod 9.

FIGS. 8 and 10 show that rotation of the coupling element 13 in order to displace the arresting element 18 from its arresting position may occur without entrainment of the driven coupling element 12 by the coupling element 13. This is due to the fact that the distance between the abutments 14 and the width of the protrusion 15 are selected in such a manner that a gap of appropriate length is defined between the protrusion 15 and either abutment 14 when the protrusion 15 engages the other abutment 14.

When the driven coupling element 12 rotates from the position of FIG. 8 back to the end position of FIG. 4, the protuberance 24 of the coupling element 12 exerts a force on the nose 26 of the releasing lever 19. The releasing lever 19 is thus pivoted in a direction opposite to the arrow Pf3, and against the biasing force of the spring 21, to a position in which the lower end of the releasing lever 19 is out of the range of motion of the nose 22 on the coupling element 13. This position of the releasing lever 19 is shown in FIG. 4. Movement of the releasing lever 19 to the position of FIG. 4 permits the coupling element 13 to rotate from the end position of FIG. 4 to the position of FIG. 6 without interference from the releasing lever 19.

The position of the coupling unit 8 which is illustrated in FIG. 4 may be referred to as a first locked position of the coupling unit 8. In the first locked position of the coupling unit 8, the air spring 5 is in its first or engaged condition and offers a high resistance to adjustment of the back rest 3. On the other hand, the position of the coupling unit 8 which is shown in FIG. 8 may be referred to as a second locked position of the coupling unit 8. In the second locked position of the coupling unit 8, the air spring 5 is in its second or disengaged condition and offers little, if any, resistance to adjustment of the back rest 3.

Starting from the position of the coupling unit 8 illustrated in FIG. 8, both locked positions of the coupling unit 8 and, hence, both conditions of the air spring 5, are achieved within a single operating stroke of the handle 6. Stated differently, the handle 6 follows a single, well-defined path in moving from its first terminal or rest position to its second terminal position and back, and the coupling unit 8 may shift from either of its locked positions to the other as the handle 6 traverses this path. Furthermore, the starting position of the handle 6 is the same regardless of whether the coupling unit 8 is to be shifted from its first locked position to its second locked position, or vice versa. Thus, the starting position of the handle 6 is always the rest position illustrated in FIGS. 5 and 9. This contributes to ease and convenience of operation.

It will be observed that the coupling unit 8 alternately assumes its first and second locked positions as the handle 6 is moved to and from its rest position.

As most clearly seen in FIG. 3, the portion of the control mechanism 4 constituted by the coupling elements 12 and 13, the arresting lever 18 and the releasing lever 19 has a relatively small depth as considered in axial direction of the connecting rod 10. This is due, in part, to the fact that the coupling elements 12 and 13, the arresting lever 18 and the releasing lever 19 are all generally flat. Another factor in the relatively small depth resides in that the coupling elements 12 and 13, the arresting lever 18 and the releasing lever 19 are arranged with the major faces thereof essentially parallel and at least partially overlapping, e.g. the major faces of the coupling elements 12 and 13 are partly overlapping as are the major faces of the levers 18 and 19. Overlap of the major faces enables adjoining ones of the coupling elements 12,13 and the levers 18,19 to be coupled to one another in a face-to-face relationship which makes it possible to maintain a relatively small depth. By designing the control mechanism 4 so that the portion thereof constituted by the coupling elements 12,13 and the levers 18,19 has a relatively small depth, the control mechanism 4 may be readily mounted in the space which is available at the underside of a chair such as the chair 1. The coupling elements 12,13 and the levers 18,19 are sturdy in spite of their flatness, and are also resistant to dirt pick-up.

As may be seen from FIGS. 4, 6, 8 and 10, the height of that portion of the control mechanism 4 constituted by the coupling elements 12,13 and the levers 18,19 may be relatively small. In fact, the height may be selected in such a manner that conventional coverings may be used as the covering material 7 of FIG. 2 with virtually no alterations.

The connecting rod 10, the arresting lever 18, and so on, are mounted on the lateral flanges 27 of the support structure for the chair 1.

It may be mentioned that one or more mechanical springs, that is, springs other than fluid-operated springs, may be arranged parallel or concentric to the air spring 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A control mechanism for a seating article having at least one adjustable component, particularly a seat or a back rest, which is connected with a biasing element, especially an air spring, convertible between a first condition in which the biasing element offers a higher first resistance to adjustment, and a second condition in which the biasing element offers a lower second resistance to adjustment, said control mechanism comprising a control element for converting the biasing element between its first and second conditions; a coupling unit for transmitting force between said control element and the biasing element, said coupling unit having a first locked position in which the biasing element is in its first condition, and a second locked position in which the biasing element is in its second condition, and said coupling unit being designed to alternately assume said first and second locked positions in response to movement of said control element; relatively rotatable first and second shafts one of which is connected with said control element and the other of which is designed to operate said biasing element, said coupling unit constituting a junction between said shafts and said coupling unit comprising cooperating first and second elements which are respectively fast with said first and second shafts; and an arresting element movable to and from an arresting position in which said arresting element arrests said first element and thereby holds said coupling unit in one of said locked positions.

2. The mechanism of claim 1, said control element having first and second terminal positions and being movable between said terminal positions along a predetermined path; and wherein said coupling unit is designed to move from either of said locked positions to the other upon movement of said control element between said terminal positions along said predetermined path.

3. The mechanism of claim 1, wherein said control element has a terminal position; and said coupling unit is arranged to assume either of said locked positions when said control element is in said terminal position.

4. The mechanism of claim 1, wherein said shafts are substantially coaxial.

5. The mechanism of claim 1, wherein said other shaft is provided with a projection for operating the biasing element.

6. The mechanism of claim 1, wherein the biasing element has an actuating member for converting the biasing element between its first and second conditions and the actuating member is movable through a predetermined distance to effect conversion of the biasing element from one condition to the other, one of said cooperating elements having two spaced-apart abutments which define a gap and the other of said cooperating elements having a portion extending into said gap and allowing for relative movement of said cooperating elements through a distance which at least approximates the predetermined distance.

7. The mechanism of claim 1, wherein said first cooperating element is fast with said other shaft.

8. The mechanism of claim 1, wherein said arresting element comprises a lever.

9. The mechanism of claim 1, wherein said arresting element comprises a detent.

10. The mechanism of claim 1, comprising biasing means for urging said arresting element towards said arresting position.

11. The mechanism of claim 1, comprising a releasing element for displacing said arresting element from said arresting position.

12. The mechanism of claim 11, wherein said releasing element comprises a lever.

13. The mechanism of claim 11, wherein said releasing element is mounted on said arresting element.

14. The mechanism of claim 11, wherein said cooperating elements, said arresting element and said releasing element are all substantially flat and have respective major faces, said cooperating elements, said arresting element and said releasing element being arranged such that said major faces are substantially parallel to one another and a major face of each at least partially overlaps a major face of another.

15. The mechanism of claim 11, wherein said releasing element is arranged to displace said arresting element from said arresting position in response to movement of said second cooperating element.

16. The mechanism of claim 15, comprising biasing means for urging said releasing element towards said second cooperating element.

17. The mechanism of claim 15, said arresting element being out of said arresting position in the other of said locked positions; and wherein said first cooperating element is provided with a nose which engages said releasing element in said other locked position to hold the latter at a distance from said second cooperating element.

18. The mechanism of claim 17, wherein said other locked position is said first locked position.

19. The mechanism of claim 15, wherein said releasing element is arranged to be adjacent to said second cooperating element in said one locked position so that movement of said second cooperating element out of said one locked position causes shifting of said releasing element and an accompanying displacement of said arresting element out of said arresting position.

20. The mechanism of claim 19, wherein said one locked position is said second locked position.

21. The mechanism of claim 20, wherein said first cooperating element is fast with said other shaft.

22. The mechanism of claim 1, wherein one of said cooperating elements is provided with a pair of spaced abutments, and the other of said cooperating elements is provided with a protrusion which is received between and is movable relative to said abutments.

23. The mechanism of claim 22, wherein said abutments are arranged at the periphery of said one cooperating element.

24. The mechanism of claim 22, the biasing element having an actuating member for converting the biasing element between its first and second conditions, and the actuating member being movable through a predetermined distance to effect conversion of the biasing element from one condition to the other; and wherein said abutments define a gap having a length such that the difference between said length and the width of said protrusion at least approximates the predetermined distance.

25. The mechanism of claim 22, wherein said one cooperating element is fast with said other shaft.

26. The mechanism of claim 1, each of said shafts having an end position, and said coupling unit being in one of said locked positions when said shafts are in said end positions; and wherein said shafts are arranged to be biased towards said end positions.

* * * * *